US008820713B2

(12) United States Patent
Huang

(10) Patent No.: US 8,820,713 B2
(45) Date of Patent: Sep. 2, 2014

(54) AUTOMATICALLY EXTENSIBLE TELESCOPIC APPARATUS

(76) Inventor: Han-Ching Huang, Taichung (TW)

( * ) Notice: Subject to any disclaimer, the term of this patent is extended or adjusted under 35 U.S.C. 154(b) by 259 days.

(21) Appl. No.: 13/494,774

(22) Filed: Jun. 12, 2012

(65) Prior Publication Data

US 2013/0327997 A1 Dec. 12, 2013

(51) Int. Cl.
*B66F 3/16* (2006.01)

(52) U.S. Cl.
USPC ..... 254/97; 254/95; 254/96; 254/100

(58) Field of Classification Search
USPC ..... 254/95, 96, 97, 100
See application file for complete search history.

(56) References Cited

U.S. PATENT DOCUMENTS 1,584,087 A * 5/1926 Gelder ..... 254/97
3,934,852 A * 1/1976 Weber et al. ..... 254/420

* cited by examiner

*Primary Examiner* — Lee D Wilson
*Assistant Examiner* — Shantese McDonald

(57) ABSTRACT

An automatic extensible telescopic apparatus includes an internal tube inserted in an external tube. A positioning unit includes a ferrule, two fins, an axle, a toothed wheel and a first detent. The ferrule is provided on the external tube. The fins extend from the ferrule. The axle is supported on the fins. The toothed wheel is supported on the axle and includes teeth for insertion in recesses defined in the internal tube. The first detent is supported on the fins for engagement with the toothed wheel. A handle includes two leaves and a second detent. The leaves are placed between the fins and supported on the axle. The second detent is supported on the leaves for engagement with the toothed wheel. An extending unit is connected to the axle so that the extending unit rotates the toothed wheel via the axle, thus extending the internal tube from the external tube.

15 Claims, 10 Drawing Sheets

AUTOMATICALLY EXTENSIBLE TELESCOPIC APPARATUS

BACKGROUND OF INVENTION

1. Field of Invention

The present invention relates to a telescopic apparatus and, more particularly, to an automatically extensible telescopic apparatus.

2. Related Prior Art

A conventional telescopic apparatus includes a tube inserted in another tube telescopically, a positioning unit operable for moving and positioning the tubes relative to each other, and two contact units each connected to a respective one of the tubes. The conventional telescopic apparatus is extensible by operating the positioning unit or pulling the tubes from each other. Either way, the extension of the conventional telescopic apparatus is manual.

The present invention is therefore intended to obviate or at least alleviate the problems encountered in prior art.

SUMMARY OF INVENTION

It is the primary objective of the present invention to provide an automatically extensible telescopic apparatus.

To achieve the foregoing objective, the telescopic apparatus includes an internal tube inserted in an external tube, a positioning unit, a handle, and an extending unit. The positioning unit includes a ferrule, two fins, an axle, a toothed wheel and a first detent. The ferrule is provided on the external tube. The fins extend from the ferrule. The axle is supported on the fins. The toothed wheel is supported on the axle and includes teeth for insertion in recesses defined in the internal tube. The first detent is supported on the fins for engagement with the toothed wheel. The handle includes two leaves and a second detent. The leaves are placed between the fins and supported on the axle. The second detent is supported on the leaves for engagement with the toothed wheel. The extending unit is connected to the axle so that the extending unit rotates the toothed wheel via the axle, thus extending the internal tube from the external tube.

In another aspect, the automatic extensible telescopic apparatus includes an internal tube inserted in an intermediate tube inserted in an external tube. The external tube includes apertures defined therein. The intermediate tube includes an aperture defined therein. The internal tube includes recesses defined therein. An elastic lock includes a leaf spring and a boss formed on the leaf spring. The leaf spring is placed in the intermediate tube. The boss can be inserted in one of the apertures of the external tube via the aperture of the intermediate tube. A positioning unit includes a ferrule provided on the intermediate tube, two fins formed on the ferrule, an axle rotationally supported on the fins, a toothed wheel supported on the axle and formed with teeth for insertion in the recesses, and a first detent movably supported on the fins for engagement with the toothed wheel. A handle includes two leaves placed between the fins and supported on the axle and a second detent movably supported on the leaves for engagement with the toothed wheel. An extending unit is connected to the axle so that the extending unit rotates the toothed wheel via the axle, thus extending the internal tube from the intermediate tube.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
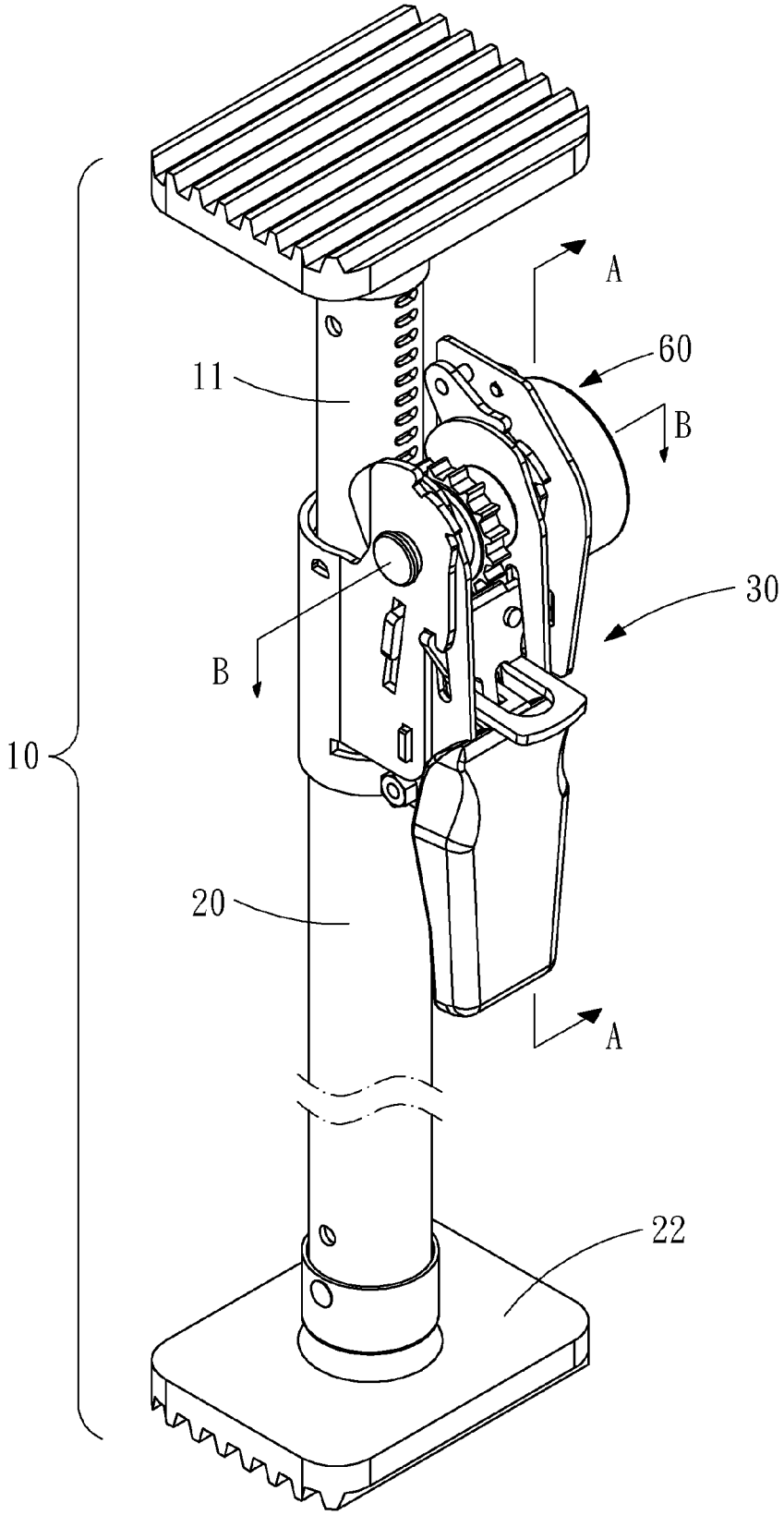
FIG. 1 is a perspective view of an automatically extensible telescopic apparatus according to the first embodiment of the present invention.

Referring to FIG. 1, an automatically extensible telescopic apparatus 10 includes an internal tube 11 telescopically inserted in an external tube 20, a positioning unit 30 operable for moving and positioning the tubes 11 and 20 relative to each other, and an extending unit 60 for moving the tubes 11 and 20 from each other according to a first embodiment of the present invention.

Figure 2:
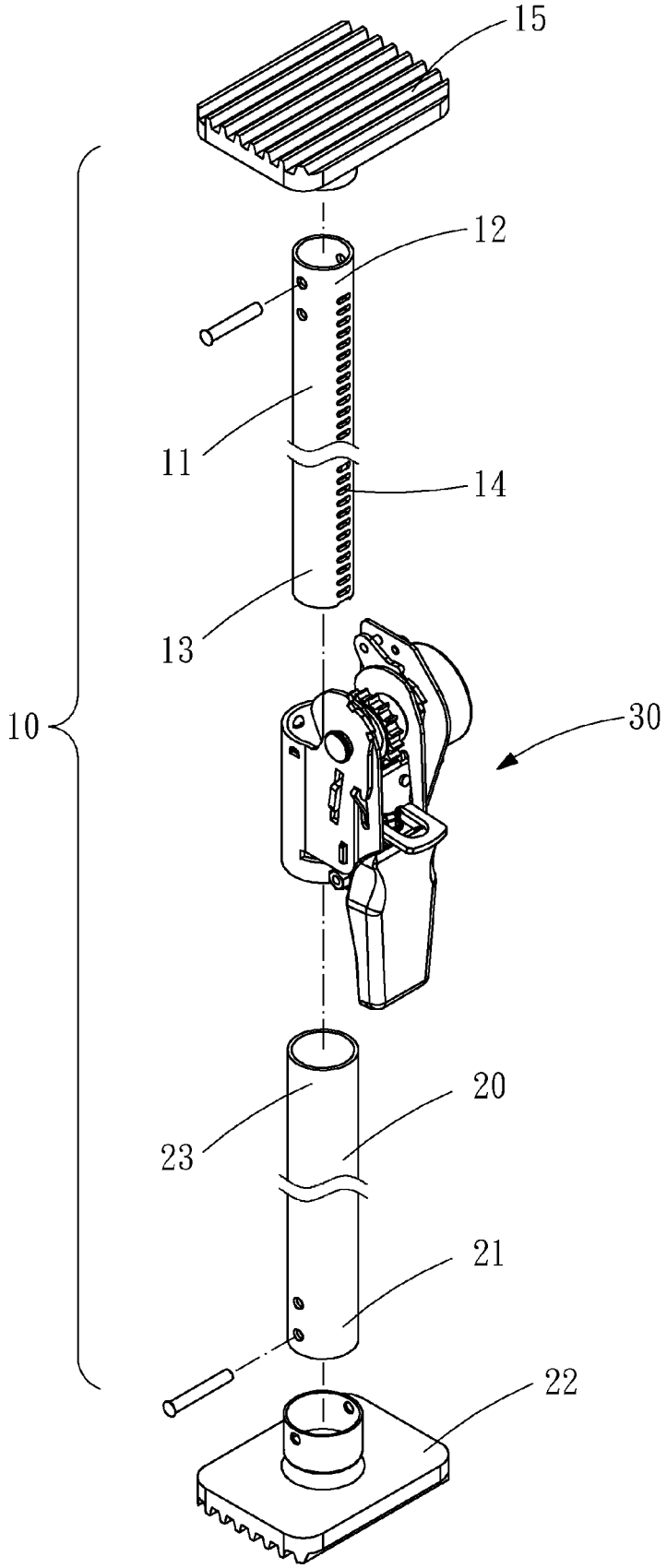
FIG. 2 is an exploded view of the automatically extensible telescopic apparatus shown in FIG. 1.

Referring to FIG. 2, the internal tube 11 includes two ends 12 and 13 and recesses 14 defined therein between the ends 12 and 13. The recesses 14 may be grooves or slots. A contact element 15 is pivotally connected to the end 12 of the internal tube 11.

The external tube 20 includes two ends 21 and 23. A contact element 22 is pivotally connected to the end 21 of the external tube 20.

Figure 3:
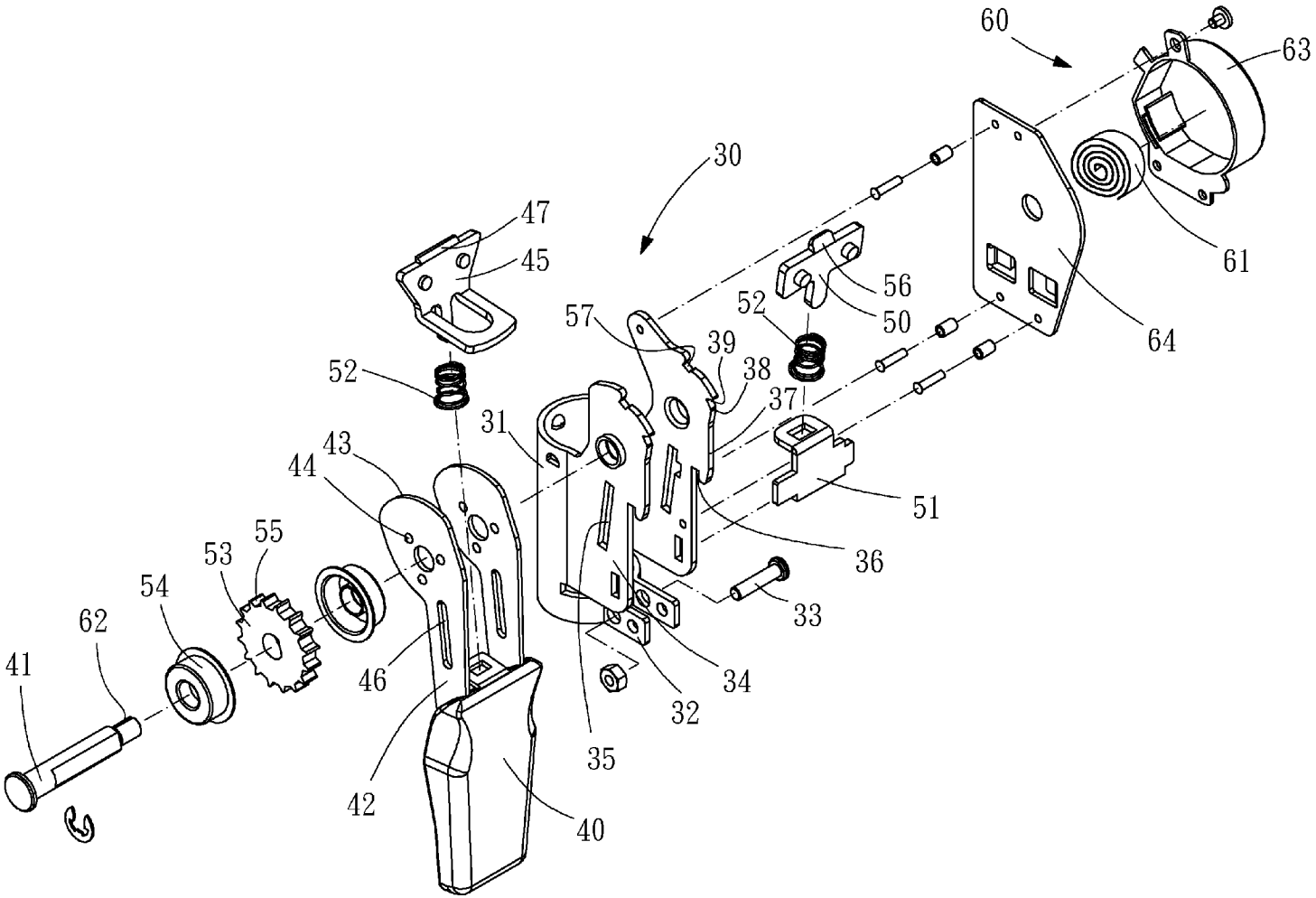
FIG. 3 is an exploded view of a positioning unit and an extending unit of the automatically extensible telescopic apparatus shown in FIG. 1.

Referring to FIG. 3, the positioning unit 30 includes a ferrule 31, a handle 40, two detents 45 and 50 and a toothed wheel 53. The ferrule 31 includes a semi-tubular body, two tabs 32 extending from two edges of the semi-tubular body, and two fins 34 extending from the edges of the semi-tubular body. Each fin 34 includes a slot 35 defined therein and an edge formed with five portions 36, 37, 38, 39 and 57. There is a peak formed between the portions 38 and 39 of the edge of each fin 34.

The handle 40 includes two leaves 42 each including a slot 46 defined therein, a cam 43 formed at an end, and three bosses 44 formed on a side of the cam 43. An axle 41 is provided with a slit 62 defined in an end.

The toothed wheel 53 includes teeth 55 formed on the periphery. There are provided two spacers 54 for positioning the toothed wheel 53 axially. The spacers 54 are in the shape of a cap.

The detent 50 includes a tongue 56 extending from a front edge, two wings extending from two lateral edges, and a tail extending from a rear edge. The tongue 56 is in the form of a ratchet. A supporting element 51 is provided with a frame perpendicularly extending from a front edge and two wings extending from two lateral edges. There is provided a first helical spring 52 for biasing the detent 50.

The detent 45 includes a tongue 47 extending from a front edge, two wings extending from two lateral edges, and a tail extending from a rear edge. The tongue 47 is in the form of a ratchet. There is provided a second helical spring 52 for biasing the detent 45.

The extending unit 60 includes a coil spring 61, a shell 63 and a plate 64. The coil spring 61 is placed in the shell 63. The shell 63 is attached to the plate 64 by welding or fasteners such as screws and rivets. Thus, the coil spring 61 is hidden by the shell 63 and the plate 64.

Figure 4:
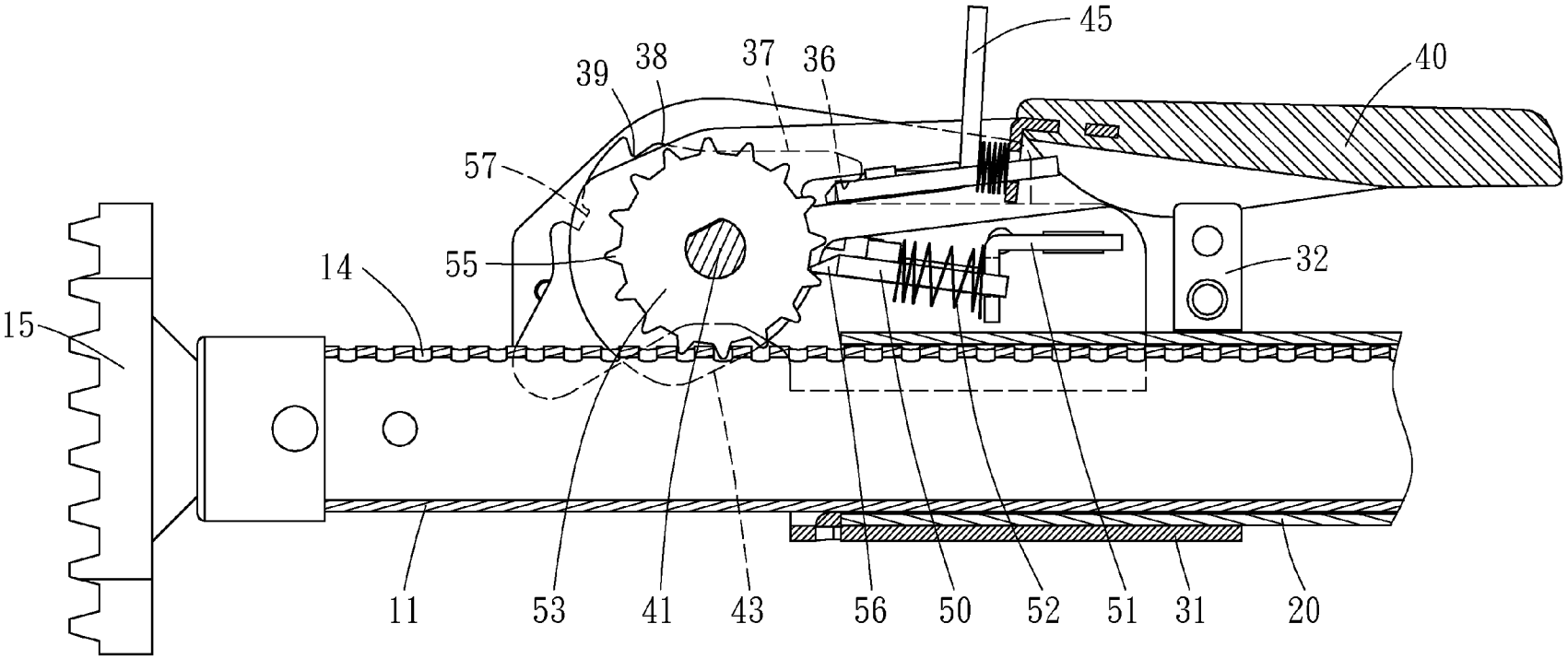
FIG. 4 is a cross-sectional view of the automatically extensible telescopic apparatus shown in FIG. 1.
Figure 5:
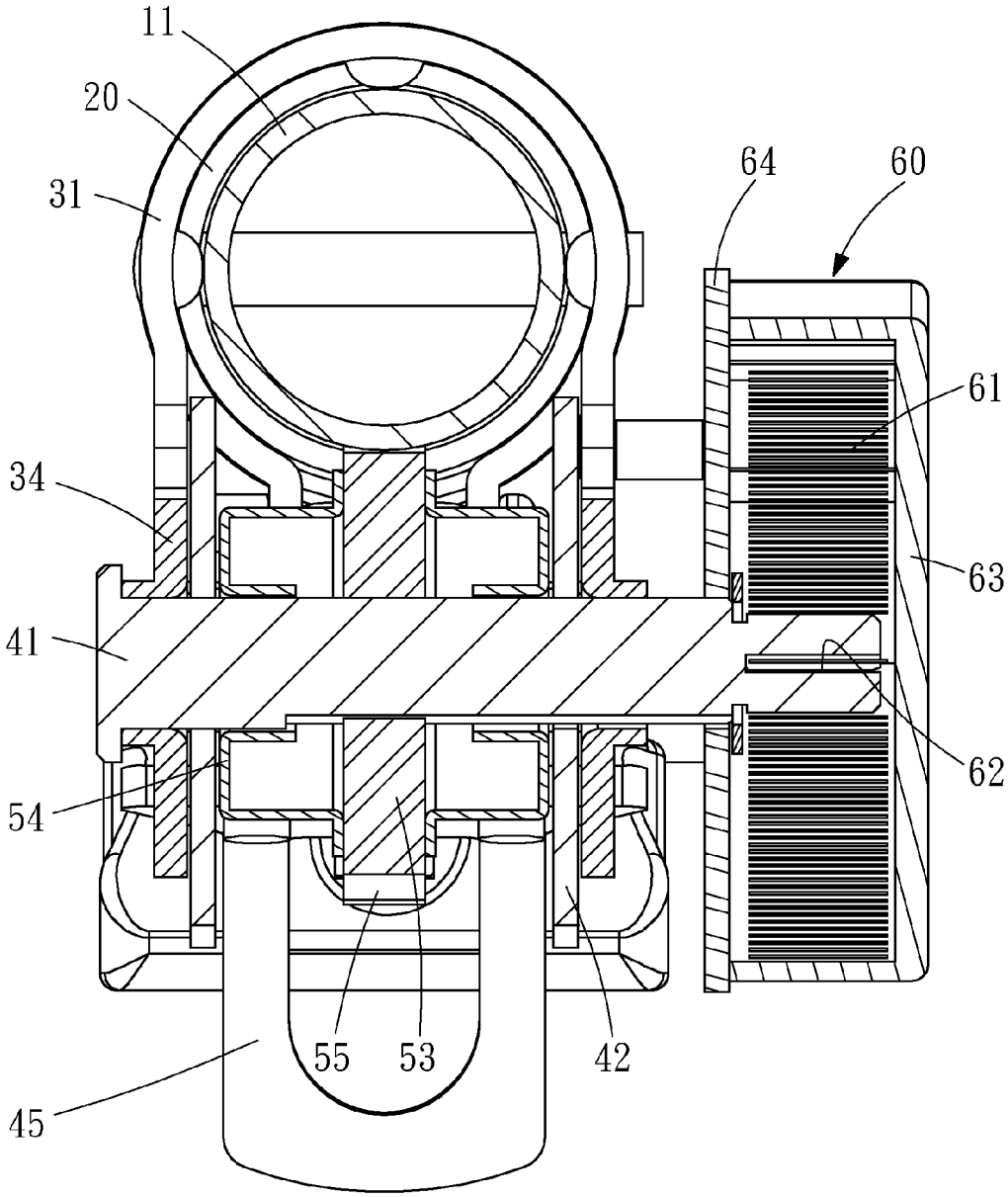
FIG. 5 is another cross-sectional view of the automatically extensible telescopic apparatus shown in FIG. 1.

Referring to FIGS. 3 to 5, each wing of the supporting element 51 is inserted in a slot defined in each fin 34. The tail of the detent 50 is inserted in the respective helical spring 52 and the frame of the supporting element 51. Each wing of the detent 50 is movably inserted in the slot 35 of each fin 34. Therefore, the first helical spring 52 is compressed between the supporting element 51 and the detent 50.

The tail of the detent 45 is inserted in the second helical spring 52 and a frame attached to or formed on the handle 40. Each wing of the detent 45 is movably inserted in the slot 46 of each leaf 42. Thus, the second helical spring 52 is compressed between the handle 40 and the detent 45.

The toothed wheel 53 is placed between the spacers 54. The spacers 54 are placed between the cams 43. The cams 43 are placed between the fins 34. Each cam 43 contacts the respective fin 34 via the bosses 44 to reduce friction between the cam 43 and the fin 34. The plate 64 is attached to one of the fins 34 by welding or fasteners such as screws or rivets. The axle 41 is inserted in the fins 34, the cams 43, the spacers 54, the toothed wheel 53, and the shell 63. An external end of the coil spring 61 is attached to the shell 63 while an internal end of the coil spring 61 is inserted in the slit 62. The coil spring 61 is loaded previously.

The ferrule 31 is placed around the end 23 of the external tube 20. The tabs 32 are forced toward each other by a fastener 33 such as a screw and rivet. Thus, the positioning unit 30 is retained on the external tube 20.

Referring to FIG. 4, each wing of the detent 45 is placed in a recess defined in the first portion 36 of the edge of the respective fin 34 to prevent the handle 40 from pivoting. The tongue 47 is kept away from the toothed wheel 53. The tongue 56 is in contact with the toothed wheel 53. The tongue 56 however allows the toothed wheel 53 to rotate clockwise. Hence, the automatically extensible telescopic apparatus 10 can manually be extended by pulling the internal tube 11 from the external tube 20. This manual extension is however slow and troublesome.

Figure 6:
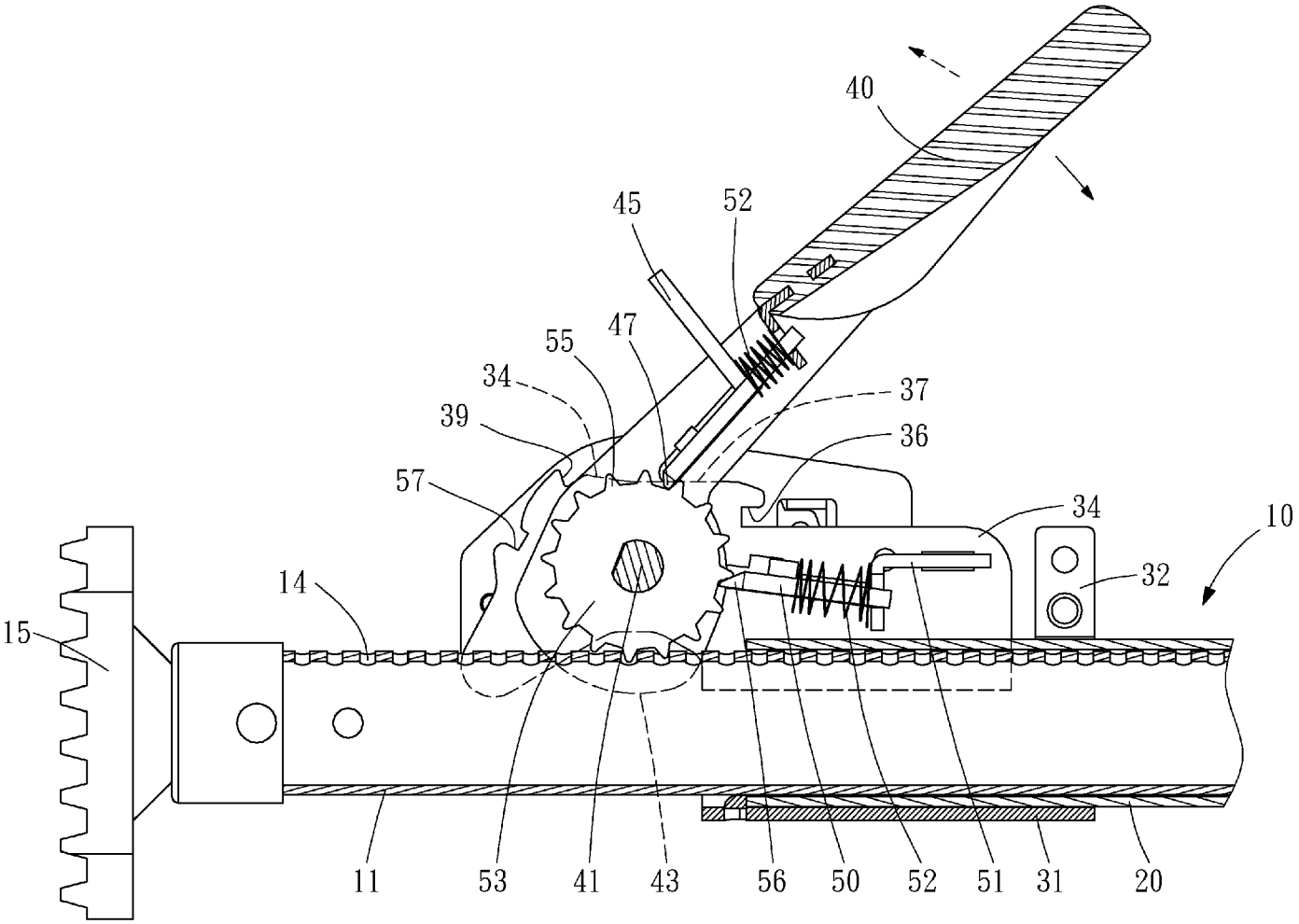
FIG. 6 is a cross-sectional view of the automatically extensible telescopic apparatus in another position than shown in FIG. 4.

Referring to FIG. 6, each wing of the detent 45 is moved out of the recess defined in the first portion 36 of the edge of the respective fin 34 to allow the handle 40 to pivot. Each wing of the detent 45 is placed on the second portion 37 of the edge of the respective fin 34. The tongues 47 and 56 are both in contact with the toothed wheel 53.

The handle 40 is pivoted in an idle direction as indicated by a phantom arrow head. The tongue 47 rattles on and moves past some of the teeth 55 of the toothed wheel 53. The toothed wheel 53 is not rotated so that the internal tube 11 is not further inserted into the external tube 20.

Then, the handle 40 is pivoted in an active direction as indicated by a solid arrow head. One of the teeth 55 of the toothed wheel 53 is engaged with the tongue 47. Thus, the toothed wheel 53 is rotated by the handle 40 via the second detent 45. Accordingly, the internal tube 11 is extended from the external tube 20.

Figure 7:
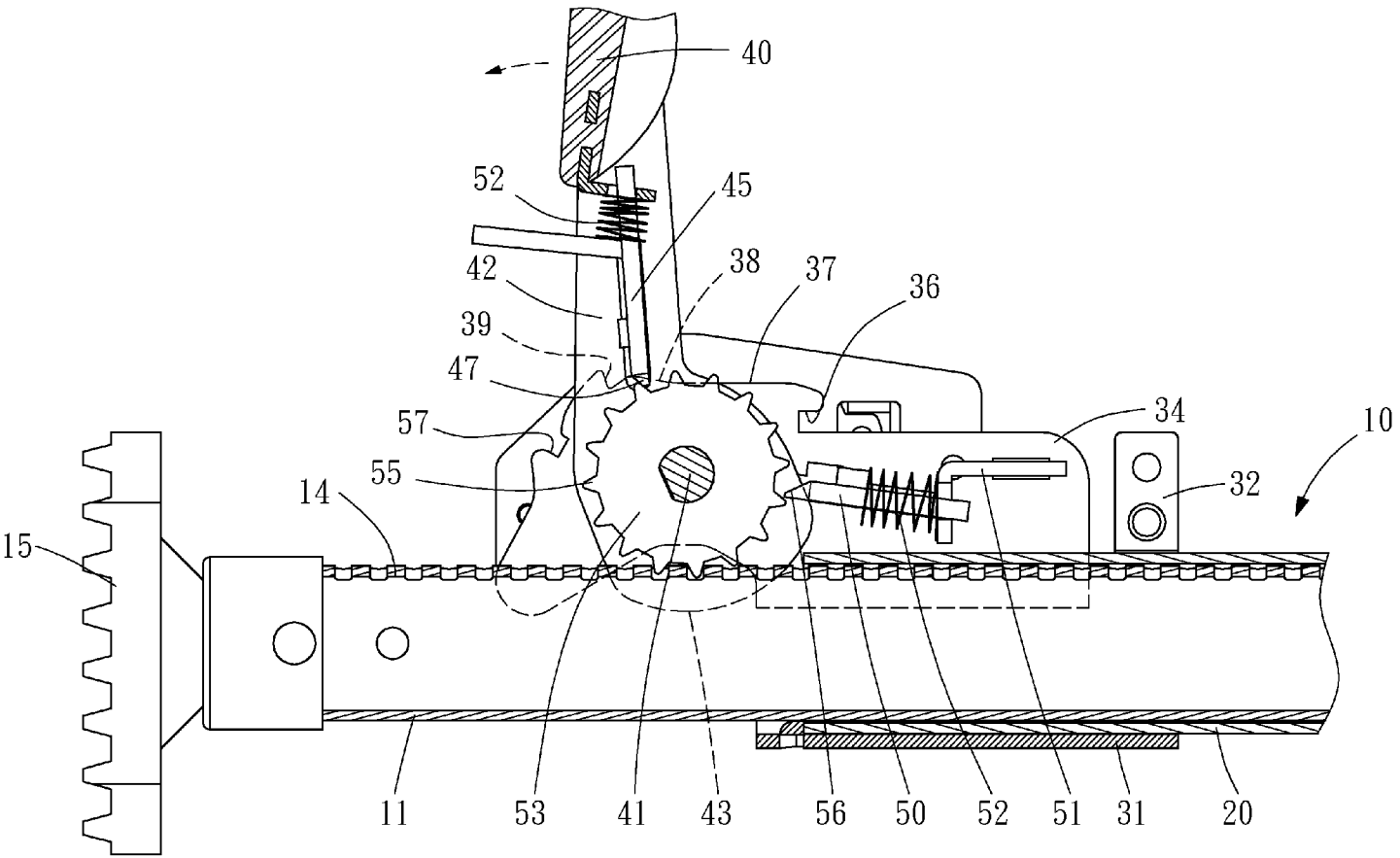
FIG. 7 is a cross-sectional view of the automatically extensible telescopic apparatus in another position than shown in FIG. 6.

Referring to FIG. 7, each wing of the detent 45 is placed on the third portion 38 of the edge of the respective fin 34 from the second portion 37 of the same. The tongue 56 of the first detent 50 is moved from the toothed wheel 53 by the cams 43, and the tongue 47 of the second detent 40 is moved from the toothed wheel 53 by the fins 34.

Figure 8:
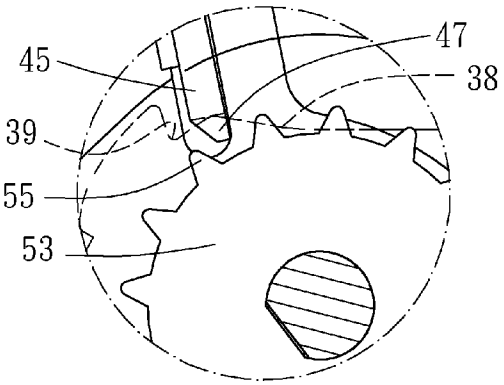
FIG. 8 is an enlarged, partial, cross-sectional view of the automatically extensible telescopic apparatus in another position than shown in FIG. 7.

Referring to FIG. 8, each wing of the detent 45 is placed at a peak between the portions 38 and 39 on its way to the fourth portion 39 of the edge of the respective fin 34 from the second portion 37 of the same. At this moment, the tongue 56 of the first detent 50 is disengaged from the toothed wheel 53 by the cams 43 while the tongue 47 of the second detent 40 is disengaged from the toothed wheel 53 by the fins 34. Thus, the toothed wheel 53 is freely rotated by the coil spring 61 via the axle 41. Hence, the internal tube 11 is extended further from the external tube 20 at a fast pace.

Figure 9:
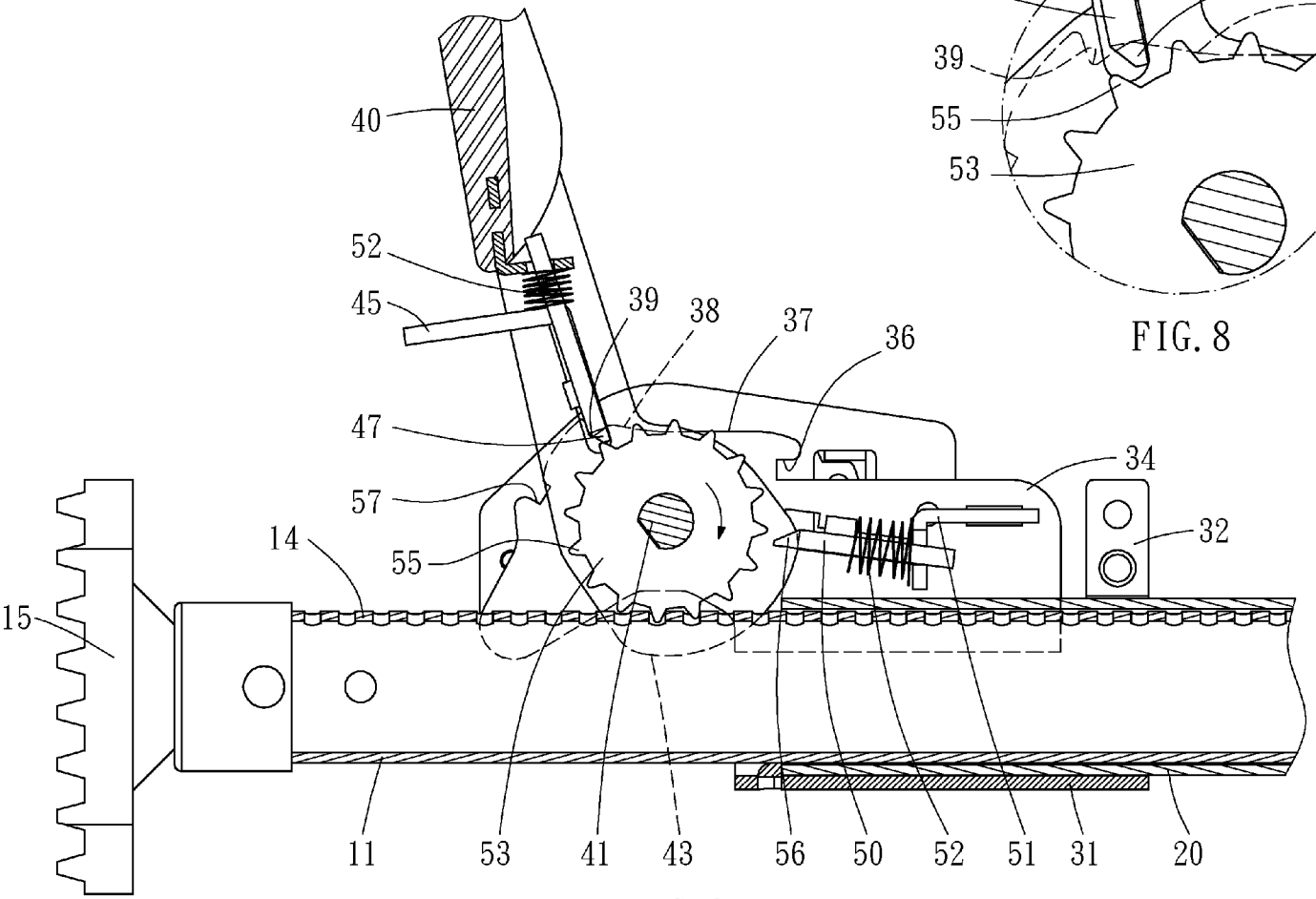
FIG. 9 is a cross-sectional view of the automatically extensible telescopic apparatus shown in FIG. 8.

Referring to FIG. 9, each wing of the detent 45 is placed on the fourth portion 39 of the edge of the respective fin 34. The tongue 56 is kept away from the toothed wheel 53. The tongue 47 is slightly in contact with the toothed wheel 53. Preferably, about 0.5 to 2.5 mm of the tongue 47 is in contact with the teeth 55. Thus, the second helical spring 52 exerts a small force on the toothed wheel 53 via the tongue 47. Therefore, the toothed wheel 53 is rotated clockwise by the coil spring 61 via the axle 41 with a little resistance from the second helical spring 52 via the tongue 47. Thus, the internal tube 11 is extended further from the external tube 20 at a contained pace. Although contained, this automatic extension is still more convenient than the manual extension.

Figure 10:
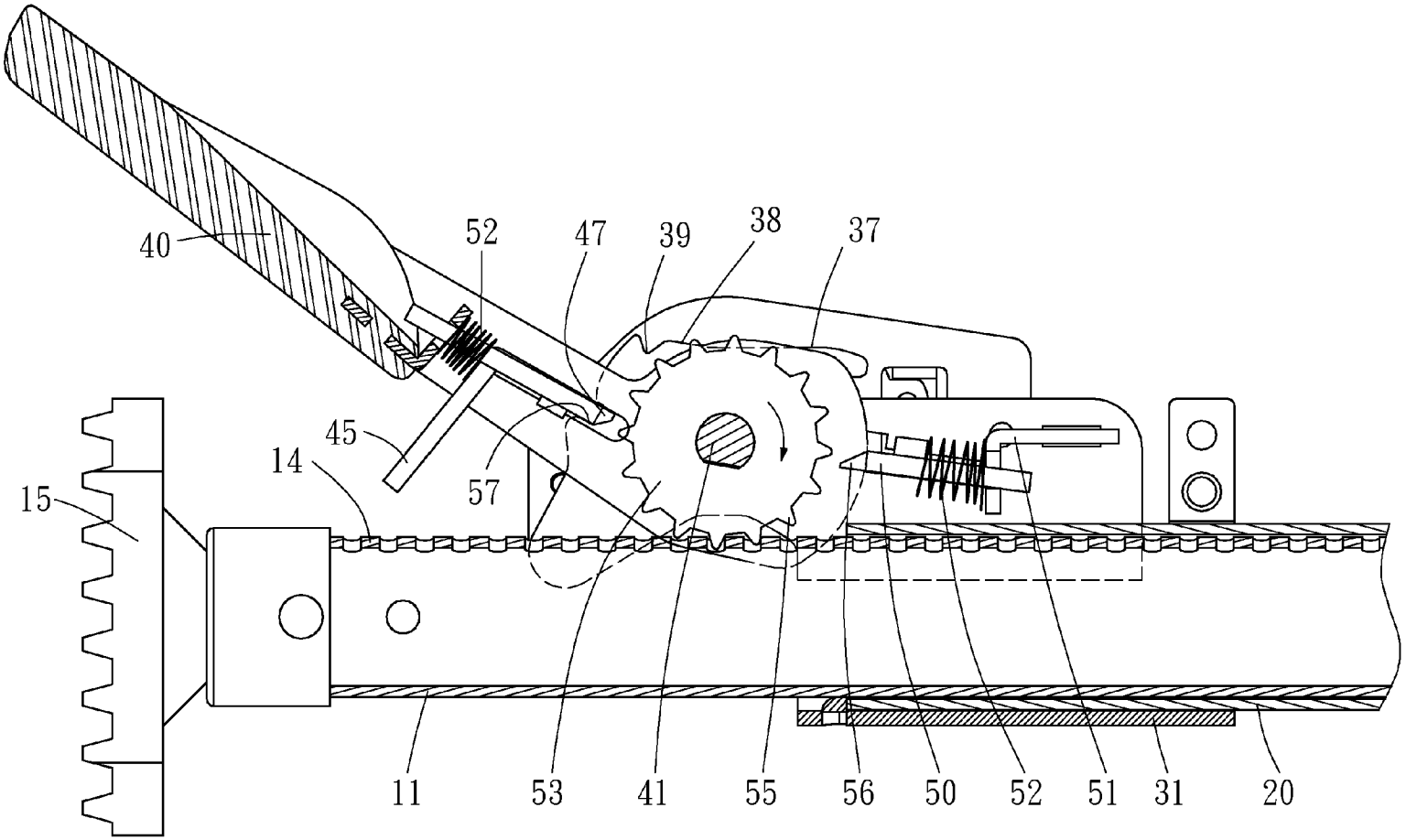
FIG. 10 is a cross-sectional view of the automatically extensible telescopic apparatus in another position than shown in FIG. 8.

Referring to FIG. 10, each wing of the detent 45 is placed on the fifth portion 57 of the edge of the respective fin 34. The tongues 47 and 56 are both kept away from the toothed wheel 53. Hence, the toothed wheel 53 is freely rotated by the coil spring 61 via the axle 41. Thus, the internal tube 11 is extended further from the external tube 20 at a fast pace before the contact elements 15 contact two objects.

Figure 11:
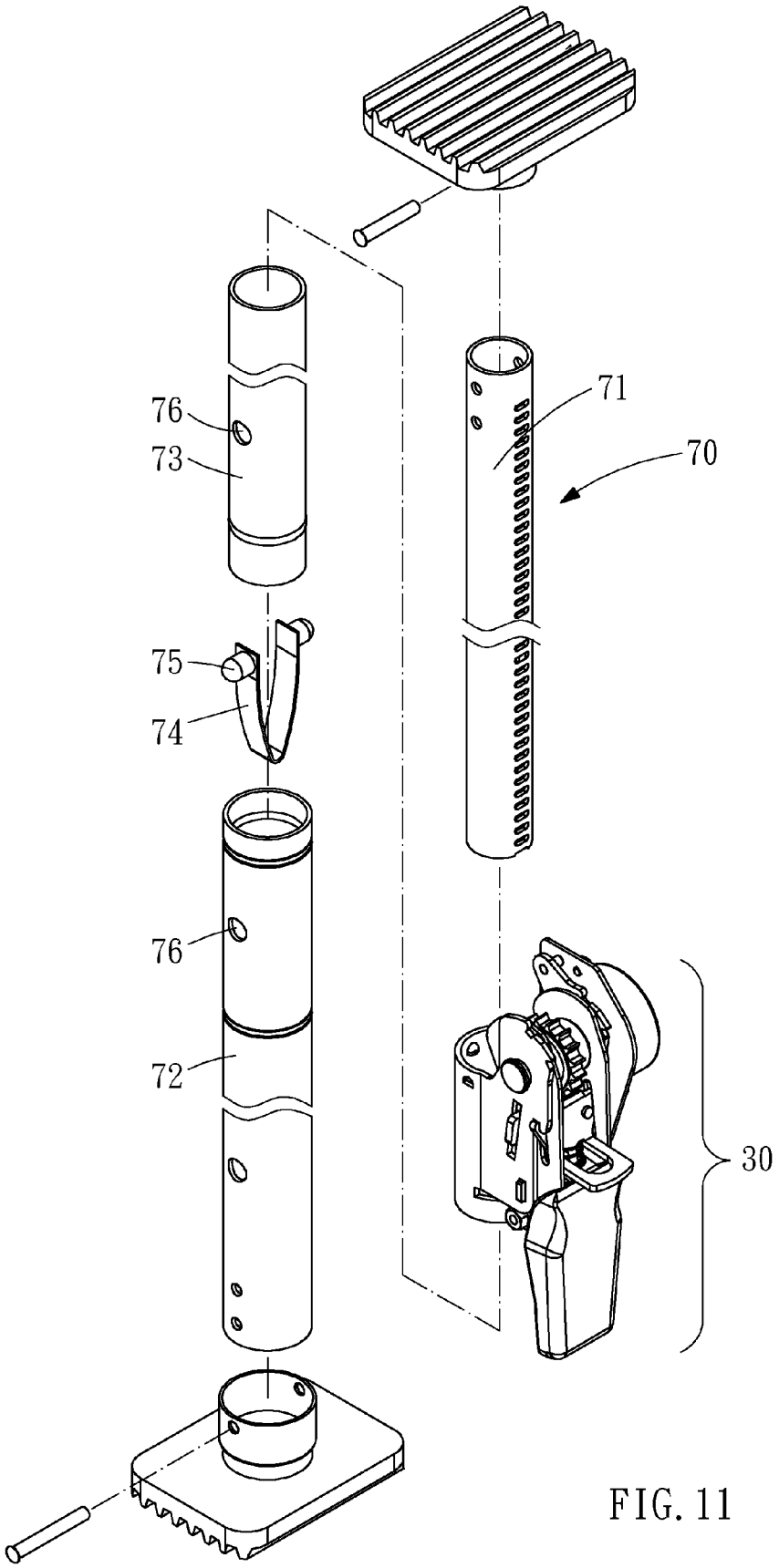
FIG. 11 is an exploded view of an automatically extensible telescopic apparatus according to the second embodiment of the present invention.

Referring to FIG. 11, there is shown an automatically extensible telescopic apparatus 70 according to a second embodiment of the present invention. The second embodiment is like the first embodiment except including three tubes 71, 72 and 73 instead of the tubes 11 and 20. The tube 71 is inserted in the tube 73 which is inserted in the tube 72. The positioning unit 30 is connected to the tube 72. The tube 72 includes pairs of apertures 76 defined therein. The tube 73 includes a pair of apertures 76 defined therein. An elastic lock includes a V-shaped leaf spring 74 and two bosses 75 each formed at an end of the leaf spring 74. The elastic lock is placed in the tube 73. By the V-shaped leaf spring 74, the pair of bosses 75 is kept in the pair of apertures 76 of the tube 73. The pair of bosses 75 is inserted in a selected pair of apertures 76 of the tube 72 to keep the combination of the tube 72 with the tube 73 at a desired length.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. An automatic extensible telescopic apparatus including:
an external tube;
an internal tube inserted in the external tube and formed with recesses;
a positioning unit including:
a ferrule provided on the external tube;
two fins formed on the ferrule;
an axle rotationally supported on the fins;
a toothed wheel supported on the axle and formed with teeth for insertion in the recesses; and
a first detent movably supported on the fins for engagement with the toothed wheel;
a handle including:
two leaves placed between the fins and supported on the axle; and
a second detent movably supported on the leaves for engagement with the toothed wheel; and
an extending unit connected to the axle so that the extending unit rotates the toothed wheel via the axle, thus extending the internal tube from the external tube.

2. The automatic extensible telescopic apparatus according to claim 1, wherein each of the fins includes a first portion, a second portion, a third portion, a fourth portion and a fifth portion sequentially.

3. The automatic extensible telescopic apparatus according to claim 2, wherein the handle cannot be pivoted when the second detent is placed on the first portion of the fins.

4. The automatic extensible telescopic apparatus according to claim 3, wherein the second detent includes a tongue that engages with one of the teeth as the handle is pivoted in an active direction and rattles on the teeth as the handle is pivoted in an idle direction when the second detent is placed on the second portion of the fins.

5. The automatic extensible telescopic apparatus according to claim 4, wherein the first detent includes a tongue that rattles on the teeth as the handle is pivoted in the active direction and engages with one of the teeth as the handle is pivoted in an idle direction when the second detent is placed on the second portion of the fins.

6. The automatic extensible telescopic apparatus according to claim 5, wherein the first detent is moved further from the toothed wheel by the leaves and the first detent is moved further from the toothed wheel when the second detent is moved on the third portion of the fins.

7. The automatic extensible telescopic apparatus according to claim 6, wherein the first detent is kept away from the toothed wheel by the leaves and the first detent rattles on the toothed wheel hat is rotated by the extending unit via the axle to extend the internal tube from the external tube when the second detent is placed on the fourth portion of the fins.

8. The automatic extensible telescopic apparatus according to claim 7, wherein the first detent is disengaged from the toothed wheel by the leaves and the tongue of the second detent is disengaged from the toothed wheel by the fins as the second detent is placed at a peak between the third and fourth portions of the fins.

9. The automatic extensible telescopic apparatus according to claim 8, wherein the first and second detents are disengaged from the toothed wheel that is rotated by the extending unit to extend the internal tube from the external tube when the second detent is placed on the fifth portion of the fins.

10. The automatic extensible telescopic apparatus according to claim 1, wherein the positioning unit further includes two spacers for sandwiching the toothed wheel, wherein the spacers are placed between the leaves.

11. The automatic extensible telescopic apparatus according to claim 1, wherein the extending unit includes a coil spring formed with an external end connected to the ferrule and an internal end connected to the axle.

12. The automatic extensible telescopic apparatus according to claim 11, wherein the extending unit further includes a shell for containing the coil spring, wherein the shell is connected to the ferrule.

13. The automatic extensible telescopic apparatus according to claim 12, wherein the extending unit further includes a plate connected to the shell, wherein the plate is connected to the ferrule.

14. The automatic extensible telescopic apparatus according to claim 13, wherein the plate is connected to one of the fins.

15. An automatic extensible telescopic apparatus including:
an external tube including apertures defined therein;
an intermediate tube inserted in the external tube and formed with an aperture;
an internal tube inserted in the intermediate tube and formed with recesses;
an elastic lock including a leaf spring placed in the intermediate tube and a boss extending from the leaf spring into one of the apertures of the external tube via the aperture of the intermediate tube;
a positioning unit including:
a ferrule provided on the intermediate tube;
two fins formed on the ferrule;
an axle rotationally supported on the fins;
a toothed wheel supported on the axle and formed with teeth for insertion in the recesses; and
a first detent movably supported on the fins for engagement with the toothed wheel;
a handle including:
two leaves placed between the fins and supported on the axle; and
a second detent movably supported on the leaves for engagement with the toothed wheel; and
an extending unit connected to the axle so that the extending unit rotates the toothed wheel via the axle, thus extending the internal tube from the intermediate tube.

* * * * *